US008980806B2

(12) United States Patent
Bhalla et al.

(10) Patent No.: US 8,980,806 B2
(45) Date of Patent: Mar. 17, 2015

(54) PREPARATION OF A POST-TREATED MOLYBDENUM AMIDE ADDITIVE COMPOSITION AND LUBRICATING OIL COMPOSITIONS CONTAINING SAME

(75) Inventors: Gaurav Bhalla, Hercules, CA (US); Man Hon Tsang, Richmond, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 241 days.

(21) Appl. No.: 13/328,959

(22) Filed: Dec. 16, 2011

(65) Prior Publication Data

US 2013/0157913 A1 Jun. 20, 2013

(51) Int. Cl.

| | |
|---|---|
| ***C01G 39/06*** | (2006.01) |
| ***C10M 159/18*** | (2006.01) |
| ***C10M 135/18*** | (2006.01) |
| ***C10M 135/12*** | (2006.01) |
| ***C10M 159/12*** | (2006.01) |

(52) U.S. Cl.

CPC ..... *C10M 159/12* (2013.01); *C10M 135/12* (2013.01); *C10M 2203/1025* (2013.01); *C10M 2215/28* (2013.01); *C10M 2219/02* (2013.01); *C10M 2219/046* (2013.01); *C10M 2219/068* (2013.01); *C10M 2223/045* (2013.01); *C10M 2227/066* (2013.01); *C10M 2227/09* (2013.01); *C10N 2210/02* (2013.01); *C10N 2210/06* (2013.01); *C10N 2220/022* (2013.01); *C10N 2230/06* (2013.01); *C10N 2230/54* (2013.01); *C10N 2240/10* (2013.01); *C10N 2260/00* (2013.01); *C10N 2260/06* (2013.01)

USPC ..... 508/363; 508/362; 508/167

(58) Field of Classification Search

CPC ..... C10M 2227/066; C10M 2201/066; C10M 2215/10

USPC ..... 508/362, 167, 363

See application file for complete search history.

(56) References Cited

U.S. PATENT DOCUMENTS

| | | | | |
|---|---|---|---|---|
| 3,373,111 | A | 3/1968 | LeSeur et al. | |
| 3,405,064 | A | 10/1968 | Miller et al. | |
| 3,419,589 | A | 12/1968 | Larson et al. | |
| 3,494,866 | A | 2/1970 | Rowan et al. | |
| 3,509,051 | A | 4/1970 | Farmer et al. | |
| 4,259,194 | A | 3/1981 | DeVries et al. | |
| 4,259,195 | A | 3/1981 | King et al. | |
| 4,261,843 | A | 4/1981 | King et al. | |
| 4,263,152 | A | 4/1981 | King et al. | |
| 4,612,132 | A * | 9/1986 | Wollenberg et al. | 508/291 |
| 4,705,643 | A | 11/1987 | Nemo et al. | |
| 4,713,188 | A | 12/1987 | Wollenberg | |
| 4,737,160 | A | 4/1988 | Efner | |
| 4,746,446 | A | 5/1988 | Wollenberg et al. | |
| 5,468,891 | A | 11/1995 | Udding et al. | |
| 5,851,965 | A * | 12/1998 | Harrison et al. | 508/291 |
| 6,174,842 | B1 | 1/2001 | Gatto et al. | |
| 6,962,896 | B2 | 11/2005 | Ruhe, Jr. et al. | |
| 2003/0166477 | A1 * | 9/2003 | Abraham et al. | 508/198 |
| 2009/0143261 | A1 | 6/2009 | Takeoka et al. | |
| 2009/0247434 | A1 | 10/2009 | Bhalla et al. | |

* cited by examiner

*Primary Examiner* — Prem C Singh
*Assistant Examiner* — Francis C Campanell
(74) *Attorney, Agent, or Firm* — Joseph P. Foley

(57) ABSTRACT

The invention is directed to oil soluble additive compositions, lubricating oil compositions, and additive concentrates comprising the salt of (1) a molybdenum oxide, sulfide, or oxysulfide; (2) an amide reaction product of a carboxylic acid component and a polyamine component wherein the charge mole ratio (CMR) of the carboxylic acid component to the polyamine component is about 2:1 to 1:1; and (3) a post-treating agent.

32 Claims, No Drawings

PREPARATION OF A POST-TREATED MOLYBDENUM AMIDE ADDITIVE COMPOSITION AND LUBRICATING OIL COMPOSITIONS CONTAINING SAME

FIELD OF THE INVENTION

This invention relates to new lubricating oil additives and lubricating oil compositions. More specifically, it relates to new lubricating oil compositions containing a friction reducing component comprising the post-treated salt of a molybdenum oxide, sulfide, or oxysulfide and an amide.

BACKGROUND OF THE INVENTION

Molybdenum disulfide has long been known as a desirable additive for use in lubricating oil compositions. Molybdenum disulfide is ordinarily finely ground and then dispersed in the lubricating oil composition to impart friction modifying and antiwear properties. However, one of the major detriments to using finely ground molybdenum disulfide is its lack of solubility.

As an alternative to using finely ground molybdenum disulfide as a friction modifier, a number of other approaches involving various salts of molybdenum compounds have been employed. Molybdenum dithiocarbamates (MoDTC) and molybdenum dithiophosphates (MoDTP) are well known in the art to impart friction modifying properties. Representative compositions of MoDTC are described in Larson et al., U.S. Pat. No. 3,419,589, which teaches molybdenum (VI) dioxide dialkyldithiocarbamates; Farmer et al., U.S. Pat. No. 3,509,051, which teaches sulfurized oxymolybdenum dithiocarbamates; and Sakurai et al., U.S. Pat. No. 4,098,705, which teaches sulfur containing molybdenum dihydrocarbyl dithiocarbamate compositions.

Representative compounds of MoDTP are the compositions described in Rowan et al., U.S. Pat. No. 3,494,866, such as oxymolybdenum diisopropylphosphorodithioate.

Another method of incorporating molybdenum compounds in oil is to prepare a colloidal complex of molybdenum disulfide or oxysulfides dispersed using known dispersants. Known dispersants include basic nitrogen containing compounds including succinimides, carboxylic acid amides, phosphonoamides, thiophosphonoamides, Mannich bases, and hydrocarbonpolyamines.

King et al., U.S. Pat. No. 4,263,152; King et al., U.S. Pat. No. 4,261,843; and King et al., U.S. Pat. No. 4,259,195 teach molybdenum compounds used as anti-oxidant and anti-wear additives comprising an acidic molybdenum compound and a basic nitrogen compound which acts as a dispersant.

DeVries et al., U.S. Pat. No. 4,259,194 discloses a sulfur containing additive comprising the reaction product of ammonium tetrathiomolybdate and a basic nitrogen compound for use as an anti-oxidant, anti-wear agent, and friction modifier.

Nemo, U.S. Pat. No. 4,705,643 teaches the preparation of carboxylic acid amides as detergent additives in lubricating oils.

Udding et al., U.S. Pat. No. 5,468,891 describes antifriction additives for lubricating oils comprising a molybdenum-containing complex prepared by reacting an alkaline earth metal salt of a carboxylic acid, an amine and a source of cationic molybdenum, wherein the ratio of the number of equivalents of acid groups to the number of moles of molybdenum (eq:mol) is in the range from 1:10 to 10:1, and the ratio of the number of equivalents of acid groups to the number of moles of amine (eq:mol) is in the range from 20:1 to 1:10.

Ruhe, Jr. et al., U.S. Pat. No. 6,962,896 describes antioxidant additives for lubricating oils comprising low color molybdenum compounds and polyamide dispersants including molybdenum oxysulfide polyamides.

Gatto et al., U.S. Pat. No. 6,174,842 discloses a lubricating oil composition comprising a lubricating oil, an oil-soluble molybdenum compound substantially free of reactive sulfur, an oil-soluble diarylamine and a calcium phenate as an antiwear and anti-oxidant additive.

SUMMARY OF THE INVENTION

An embodiment of the present invention is directed to an oil soluble additive composition prepared by a process comprising:

(1) reacting a molybdenum component;

(2) an amide wherein said amide comprises the reaction product of a carboxylic acid component and a polyamine component, wherein the charge mole ratio of the carboxylic acid component to the polyamine component is about 2:1 to 1:1;

(3) a sulfur source wherein the ratio of sulfur to molybdenum is about 2:1; and (4) a post-treating agent.

An embodiment of the present invention is directed to a lubricating oil composition comprising:

a. an oil of lubricating viscosity and b. the reaction product of i. a molybdenum component;

ii. an amide wherein said amide comprises the reaction product of a carboxylic acid component and a polyamine component, wherein the charge mole ratio of the carboxylic acid component to the polyamine component is about 2:1 to 1:1;

iii. a sulfur source wherein the ratio of sulfur to molybdenum is about 2:1; and iv. a post-treating agent.

An embodiment of the present invention is directed to a process for preparing an oil soluble additive composition which comprises reacting:

a. a molybdenum component;

b. an amide wherein said amide comprises the reaction product of a carboxylic acid component and a polyamine component, wherein the charge mole ratio of the carboxylic acid component to the polyamine component is about 2:1 to 1:1;

c. a sulfur source wherein the ratio of sulfur to molybdenum is about 2:1; and d. a post-treating agent.

An embodiment of the present invention is directed to an oil soluble additive composition comprising the reaction product of:

a. a molybdenum component;

b. an amide wherein said amide comprises the reaction product of a carboxylic acid component and a polyamine component, wherein the charge mole ratio of the carboxylic acid component to the polyamine component is about 2:1 to 1:1;

c. a sulfur source wherein the ratio of sulfur to molybdenum is about 2:1; and d. a post-treating agent.

DETAILED DESCRIPTION OF THE INVENTION

While the invention is susceptible to various modifications and alternative forms, specific embodiments thereof and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DEFINITIONS

The following terms will be used throughout the specification and will have the following meanings unless otherwise indicated.

The term "polyamines" refers to organic compounds containing more than one basic nitrogen. The organic portion of the compound may contain aliphatic, cyclic, or aromatic carbon atoms.

The term "polyalkyleneamines" or "polyalkylenepolyamines" refers to compounds represented by the general formula $$H_2N(—R—NH)_n—H$$

wherein R is an alkylene group of preferably 2-3 carbon atoms and n is an integer of from about 1 to 11.

The term "amide" or "polyamide" refers to the reaction product of a carboxylic acid, carboxylate, anhydride of a carboxylic acid, or ester of a carboxylic acid and a polyamine.

The terms "molybdenum oxide," "molybdenum sulfide," and "molybdenum oxysulfide" refer to compounds of the general formula $MoO_xS_y$ wherein $x \geq 0$, $y \geq 0$, and $12 \geq (x+y) \geq 2$.

The term "carboxylic acid component" refers to carboxylic acids, carboxylates, carboxylic anhydrides, and the esters of carboxylic acids.

The term "fatty acid" refers to a carboxylic acid component derived from or contained in an animal or vegetable fat or oil comprising an alkyl chain of from 4 to 22 carbon atoms with a terminal carboxyl group.

The precise molecular formula of the oil soluble additive composition of the invention comprising the post-treated salt of (1) a molybdenum oxide, sulfide, or oxysulfide; and (2) an amide are not known with certainty; however, they are believed to be compounds in which molybdenum, whose valences are satisfied with atoms of oxygen and sulfur is either complexed by or the salt of one or more basic nitrogen components of the amide used in the preparation of these additives.

Molybdenum Component

The molybdenum component used to prepare the oil soluble additive composition of the present invention is a molybdenum containing compound which is a molybdenum oxide, sulfide, or oxysulfide having the general formula of $MoO_xS_y$ wherein $x \geq 0$, $y \geq$ and $12 \geq (x+y) \geq 2$. The molybdenum component can include molybdenum in any oxidation state. The molybdenum component useful in the preparation of the oil-soluble additive composition of the invention may be derived from molybdenum compounds including, but not limited to, molybdenum hexacarbonyl, molybdic acid, ammonium molybdate, sodium molybdate, potassium molybdate, other alkali metal molybdates, alkaline earth metal molybdates, $MoOCl_4$, $MoO_2Br_2$, and $Mo_2O_3Cl_6$. Other molybdenum components include molybdenum trioxide, ammonium tetrathiomolybdate, and molybdenum disulfide. Preferred molybdenum components are molybdenum trioxide and those components derived from molybdic acid and ammonium molybdate. A more preferred molybdenum component is molybdenum trioxide.

Sulfur Source

When employed, representative sulfur sources for preparing the molybdenum components of the oil soluble additive compositions of this invention include but are not limited to sulfur, hydrogen sulfide, sulfur monochloride, sulfur dichloride, phosphorus pentasulfide, $R_2S_x$ where R is hydrocarbyl, preferably $C_1$-$C_{40}$ alkyl, and x is at least 2, inorganic sulfides and polysulfides such as $(NH_4)_2S_x$, where x is at least 1, thioacetamide, thiourea, and mercaptans of the formula RSH where R is as defined above. Also useful as sulfurizing agents are traditional sulfur-containing antioxidants such as wax sulfides and polysulfides, sulfurized olefins, sulfurized carboxylic acid esters and sulfurized ester-olefins, and sulfurized alkylphenols and the metal salts thereof.

Preferred sulfur sources are sulfur, hydrogen sulfide, phosphorus pentasulfide, $R_2S_x$ where R is hydrocarbyl, preferably $C_1$-$C_{10}$ alkyl, and x is at least 3, mercaptans wherein R is $C_1$-$C_{10}$ alkyl, inorganic sulfides and polysulfides, thioacetamide, and thiourea. Most preferred sulfur sources are sulfur, hydrogen sulfide, phosphorus pentasulfide, and inorganic sulfides and polysulfides.

Amide Component

The amides used in the preparation of the oil soluble additive composition of the present invention are the reaction product of a carboxylic acid component and a polyamine component. In the reaction of the carboxylic acid component and the amine component to form the amide, the charge mole ratio of the carboxylic acid component to amine component is about 2:1 to 1:1. Preferably the charge mole ratio of the carboxylic acid component to amine component is about 1.7:1 to 1:1. In another embodiment, the charge mole ratio of the carboxylic acid component to amine component is about 1.5:1 to 1:1. In a further embodiment, the charge mole ratio is from about 1.7:1 to about 1.3:1.

In one embodiment, the amide is derived from 1) an aliphatic carboxylic acid component having from about 4 and 40 carbons and 2) a polyamine component having from about 2 and 10 nitrogens. In a preferred embodiment the carboxylic acid component is isostearic acid and the polyamine component is selected from the group consisting of tetraethylenepentamine, diethylenetriamine, ethylenediamine, and mixtures thereof.

The carboxylic acid component and polyamine component described herein below can be reacted to form amides prior to or during reaction with the molybdenum component. Amide compositions useful in the invention include those disclosed in U.S. Pat. No. 3,405,064, the disclosure of which is hereby incorporated by reference. These compositions are ordinarily prepared by reacting a carboxylic acid, carboxylic acid salt, carboxylic acid anhydride, or carboxylic acid ester having at least 4 to about 40 carbon atoms and, if desired, having pendant aliphatic groups to render the molecule oil soluble, with a polyamine, such as an ethylene diamine, to give an amide. Preferred are those amides prepared from (1) an aliphatic monocarboxylic acid, such as isostearic acid, stearic acid or mixtures thereof and (2) an ethylene polyamine, such as tetraethylenepentamine, diethylenetriamine, ethylene diamine or mixtures thereof Preferably, the amides useful in this invention will have at least one basic nitrogen.

Carboxylic Acid Component

The carboxylic acid component used in the preparation of the oil soluble additive composition of the invention includes aliphatic and aromatic carboxylic acids, carboxylic acid salts, carboxylic acid anhydrides, or carboxylic acid esters having from at least 4 to 100 carbon atoms, preferably from 4 to 60 carbon atoms, more preferred from 4 to 40 carbon atoms, and even more preferred from 10 to 30 carbon atoms. Mixtures of carboxylic acids, carboxylic acid salts, carboxylic anhydrides, and carboxylic acid esters can be used in the preparation of the invention. Preferably, the carboxylic acid component is an aliphatic carboxylic acid. Examples of aliphatic carboxylic acids include fatty acids such as isostearic acid, stearic acid, lauric acid, myrstic acid, palmitic acid, and arachidic acid. A particularly preferred carboxylic acid component is isostearic acid.

Polyamine Component

The polyamine component used in the preparation of the oil soluble additive composition of the present invention includes aromatic, cyclic, and aliphatic (linear and branched) polyamines and mixtures thereof. Examples of aromatic polyamines include, but are not limited to, phenylenediamine, 2,2'-diaminodiphenylmethane, 2,4- and 2,6-diaminotoluene, 2,6-diamino-p-xylene, multi-nuclear and condensed aromatic polyamines such as naphthylene-1,4-diamine, benzidine, 2,2'-dichloro-4,4'-diphenyl diamine and 4,4'-diaminoazobenzene. In another embodiment the polyamine component comprises polyamines of from about 5 to 32 ring members and having from about 2 to 8 amine nitrogen atoms. Such polyamine compounds include such compounds as piperazine, 2-methylpiperazine, N-(2-aminoethyl)piperazine, N-(2-hydroxyethyl)piperazine, 1,2-bis-(N-piperazinyl) ethane, 3-aminopyrrolidine, N-(2-aminoethyl)pyrrolidine, and aza crown compounds such as triazacyclononane, tetraazacyclododecane, and the like.

In a preferred embodiment, the polyamine component used in the preparation of this invention are polyalkylenepolyamines and can be represented by the general formula $$H_2N(—R—NH)_n—H$$

wherein R is an alkylene group of preferably 2-3 carbon atoms and n is an integer of from 1 to 11.

Specific examples of polyalkylenepolyamines include, but are not limited to, diethylenetriamine, triethylenetetramine, tetraethylenepentamine, pentaethylenehexamine, hexaethyleneheptamine, heptaethyleneoctamine, octaethylenenonamine, nonaethylenedecamine, decaethyleneundecamine, undecaethylenedodecamine, dipropylenetriamine, tripropylenetetramine, tetrapropylenepentamine, pentapropylenehexamine, hexapropyleneheptamine, heptapropyleneoctamine, octapropylenenonamine, nonapropylenedecamine, decapropyleneundecamine, undecapropylenedodecamine, di(trimethylene)triamine, tri(trimethylene)tetramine, tetra(trimethylene)pentamine, penta(triethylene)hexamine, hexa(trimethylene)heptamine, hepta(trimethylene)octamine, octa (trimethylene)nonamine, nona(trimethylene)decamine, deca (trimethylene)undecamine and undeca(trimethylene) dodecamine.

Post-Treating Agent

In one embodiment, a post-treating agent is employed to post-treat the product of the reaction of the molybdenum component, polyamide and sulfur. Typical post-treating agents are cyclic carbonates and epoxides. Examples of post-treating agents are disclosed in Wollenberg et al., U.S. Pat. No. 4,612,132, Wollenberg et al., U.S. Pat. No. 4,746,446; Wollenberg et al., U.S. Pat. No. 4,713,188 and the like as well as other post-treatment processes each of which are incorporated herein by reference in its entirety. Examples of other post-treating agents are disclosed in LeSeur et al., U.S. Pat. No. 3,373,111 and Efner, U.S. Pat. No. 4,737,160 and the like as well other post-treatment processes each of which are incorporated herein by reference in its entirety.

Method for Making the Oil Soluble Composition of the Present Invention

The preparation of this invention may be carried out by combining the molybdenum component and the amide component. A polar promoter can be optionally added to the reaction mixture. The amide component can be formed prior to reaction with the molybdenum component or in situ from a carboxylic acid component and a polyamine component. Preferably, the reaction product of the molybdenum component and the amide is sulfurized by reacting with a sulfur component. The preparation of this invention may be carried out by combining the molybdenum component with the sulfur component to form a molybdenum sulfide or oxysulfide prior to addition of the amide component. In a preferred embodiment, the molybdenum component and the amide are reacted to form a salt of a molybdenum oxide and an amide followed by sulfurization with a sulfur component to form the salt of a molybdenum sulfide or oxysulfide and an amide. The order of addition of the reaction components is not critical. The reaction is ordinarily carried out at atmospheric pressure; however, higher or lower pressures may be used, if desired, using methods that are well-known to those skilled in the art. A diluent may be used to enable the reaction mixture to be efficiently stirred. Typical diluents are lubricating oil and liquid compounds containing only carbon and hydrogen. If the mixture is sufficiently fluid to permit satisfactory mixing, no diluent is necessary. A diluent which does not react with the molybdenum component is desirable.

Optionally, a polar promoter may be employed in the preparation of the present invention. The polar promoter facilitates the interaction between the molybdenum component and the basic nitrogen of the polyamine or amide component. A wide variety of such promoters may be used. Typical promoters are 1,3-propanediol, 1,4-butanediol, diethylene glycol, butyl cellosolve, propylene glycol, 1,4-butyleneglycol, methyl carbitol, ethanolamine, diethanolamine, N-methyl-diethanol-amine, dimethyl formamide, N-methyl acetamide, dimethyl acetamide, ammonium hydroxides, tetraalkyl ammonium hydroxides, alkali metal hydroxides, methanol, ethylene glycol, dimethyl sulfoxide, hexamethyl phosphoramide, tetrahydrofuran, acetic acid, inorganic acids, and water. Preferred are water and ethylene glycol. Particularly preferred is water.

While ordinarily the polar promoter is separately added to the reaction mixture, it may also be present, particularly in the case of water, as a component of non-anhydrous starting materials or as waters of hydration in the molybdenum component, such as $(NH_4)_6Mo_7O_{24}.4H_2O$. Water may also be added as ammonium hydroxide.

A general method for preparing the oil soluble additive compositions of this invention comprises reacting (1) a molybdenum component and (2) an amide of a carboxylic acid and a polyamine in which the carboxylic acid and polyamine have a charge mole ratio (CMR) of between about 2:1 to 1:1. Optionally, (3) a polar promoter or (4) a diluent, to form a salt or (5) both a polar promoter and a diluent may be added. The diluent is used, if necessary, to provide a suitable viscosity to facilitate mixing and handling. Typical diluents are lubricating oil and liquid compounds containing only carbon and hydrogen. Optionally, ammonium hydroxide may also be added to the reaction mixture to provide a solution of ammonium molybdate. The molybdenum component, amide, polar promoter, if used, and diluent, if used, are charged to a reactor and heated at a temperature less than or equal to about 200° C., preferably from about 70° C. to about 120° C. The temperature is maintained at a temperature less than or equal to about 200° C., preferably at about 70° C. to about 90° C., until the molybdenum component is sufficiently reacted. The reaction time for this step is typically in the range of from about 1 to about 30 hours and preferably from about 1 to about 10 hours.

Typically excess water and any volatile diluents are removed from the reaction mixture. Removal methods include, but are not limited to, vacuum distillation or nitrogen stripping while maintaining the temperature of the reactor at a temperature less than or equal to about 200° C., preferably between about 70° C. to about 90° C. The removal of water and volatile diluents is ordinarily carried out under reduced pressure. The pressure may be reduced incrementally to avoid problems with foaming After the desired pressure is reached, the stripping step is typically carried out for a period of about 0.5 to about 5 hours and preferably from about 0.5 to about 2 hours.

The reaction mixture may be further reacted with a sulfur component as defined above, at a suitable pressure and temperature not to exceed 200° C. The sulfurization step is typically carried out for a period of from about 0.5 to about 5 hours and preferably from about 0.5 to about 2 hours. In some cases, removal of the polar promoter from the reaction mixture may be desirable prior to completion of reaction with the sulfur component.

The sulfur component is usually charged to the reaction mixture in such a ratio to provide up to 12 atoms of sulfur per atom of molybdenum. In one embodiment, the oil soluble composition of the invention will have a mole ratio of molybdenum to sulfur of 1:0 to 1:8. In another embodiment the ratio of molybdenum to sulfur is from about 1:0 to 1:4. In a further embodiment, the ratio of molybdenum to sulfur is from about 1:1 to 1:4.

In the reaction mixture the ratio of molybdenum atoms to basic nitrogen atoms provided by the amide can range from about 0.01 to 4.0 atoms of molybdenum per basic nitrogen atom. Usually the reaction mixture is charged from 0.01 to 2.00 atoms of molybdenum per basic nitrogen atom provided by the amide. Preferably from 0.4 to 1.0, and most preferably from 0.4 to 0.7, atoms of molybdenum per atom of basic nitrogen is added to the reaction mixture.

The polar promoter, which is preferably water, is ordinarily present in the ratio of 0.1 to 50 moles of water per mol of molybdenum. Preferably from 0.5 to 25 and most preferably 1.0 to 15 moles of the promoter is present per mole of molybdenum.

The charge mole ratio of the carboxylic acid component to polyamine is critical and can range from about 2:1 to 1:1. In one embodiment the charge mole ratio is from about 1.7:1 to 1:1. In another embodiment the charge mole ratio is from about 1.5:1 to 1:1. In a further embodiment the charge mole ratio is from about 1.7:1 to 1.3:1. The amide formed from the reaction of the carboxylic acid component and the polyamine may occur prior to, during, or after the introduction of the molybdenum component to the reaction mixture.

The reaction mixture (i.e., the reaction of the molybdenum component, the amide component and the optional steps described hereinabove) be further reacted with a post-treating agent such as, but not limited to, ethylene carbonate and glycerine carbonate.

Additive Concentrates

In many instances, it may be advantageous to form concentrates of the oil soluble additive composition of the present invention within a carrier liquid. These additive concentrates provide a convenient method of handling, transporting, and ultimately blending into lubricant base oils to provide a finished lubricant. Generally, the oil soluble additive concentrates of the invention are not useable or suitable as finished lubricants on their own. Rather, the oil soluble additive concentrates are blended with lubricant base oil stocks to provide a finished lubricant. It is desired that the carrier liquid readily solubilizes the oil soluble additive of the invention and provides an oil additive concentrate that is readily soluble in the lubricant base oil stocks. In addition, it is desired that the carrier liquid not introduce any undesirable characteristics, including, for example, high volatility, high viscosity, and impurities such as heteroatoms, to the lubricant base oil stocks and thus, ultimately to the finished lubricant. The present invention therefore further provides an oil soluble additive concentrate composition comprising an inert carrier fluid and from 2.0% to 90% by weight, based on the total concentrate, of an oil soluble additive composition according to the invention. The inert carrier fluid may be a lubricating oil.

These concentrates usually contain from about 2.0% to about 90% by weight, preferably 10% to 50% by weight of the oil soluble additive composition of this invention and may contain, in addition, one or more other additives known in the art and described below. The remainder of the concentrate is the substantially inert carrier liquid.

Lubricating Oil Compositions

In one embodiment of the invention, the oil soluble additive composition of the present invention can be mixed with a base oil of lubricating viscosity to form a lubricating oil composition. The lubricating oil composition comprises a major amount of a base oil of lubricating viscosity and a minor amount of the oil soluble additive composition of the present invention described above.

The lubricating oil which may be used in this invention includes a wide variety of hydrocarbon oils, such as naphthenic bases, paraffin bases and mixed base oils as well as synthetic oils such as esters and the like. The lubricating oils which may be used in this invention also include oils from biomass such as plant and animal derived oils. The lubricating oils may be used individually or in combination and generally have viscosity which ranges from 7 to 3,300 cSt and usually from 20 to 2000 cSt at 40° C. Thus, the base oil can be a refined paraffin type base oil, a refined naphthenic base oil, or a synthetic hydrocarbon or non-hydrocarbon oil of lubricating viscosity. The base oil can also be a mixture of mineral and synthetic oils. Mineral oils for use as the base oil in this invention include, for example, paraffinic, naphthenic and other oils that are ordinarily used in lubricating oil compositions. Synthetic oils include, for example, both hydrocarbon synthetic oils and synthetic esters and mixtures thereof having the desired viscosity. Hydrocarbon synthetic oils may include, for example, oils prepared from the polymerization of ethylene, i.e., polyalphaolefin or PAO, or from hydrocarbon synthesis procedures using carbon monoxide and hydrogen gases such as in a Fisher-Tropsch process. Useful synthetic hydrocarbon oils include liquid polymers of alpha olefins having the proper viscosity. Likewise, alkyl benzenes of proper viscosity, such as didodecyl benzene, can be used. Useful synthetic esters include the esters of monocarboxylic acids and polycarboxylic acids, as well as mono-hydroxy alkanols and polyols. Typical examples are didodecyl adipate, pentaerythritol tetracaproate, di-2-ethylhexyl adipate, dilaurylsebacate, and the like. Complex esters prepared from mixtures of mono and dicarboxylic acids and mono and dihydroxy alkanols can also be used. Blends of mineral oils with synthetic oils are also useful.

The lubricating oil compositions containing the oil soluble additives of this invention can be prepared by admixing, by conventional techniques, the appropriate amount of the oil soluble additives of the invention with a lubricating oil. The selection of the particular base oil depends on the contemplated application of the lubricant and the presence of other additives. Generally, the amount of the oil soluble additive of the invention in the lubricating oil composition of the invention will vary from 0.05 to 15% by weight and preferably from 0.2 to 1% by weight, based on the total weight of the lubricating oil composition. In one embodiment, the molybdenum content of the lubricating oil composition will be between about 50 parts per million (ppm) and 5000 ppm, preferably between about 90 ppm to 1500 ppm. In another embodiment the molybdenum content of the lubricating oil composition will be between about 500 ppm and 700 ppm.

Additional Additives

If desired, other additives may be included in the lubricating oil and lubricating oil concentrate compositions of this invention. These additives include antioxidants or oxidation inhibitors, dispersants, rust inhibitors, anticorrosion agents and so forth. Also, anti-foam agents, stabilizers, anti-stain agents, tackiness agents, anti-chatter agents, dropping point improvers, anti-squawk agents, extreme pressure agents, odor control agents and the like may be included.

The following additive components are examples of some of the components that can be favorably employed in the lubricating oil compositions of the present invention. These examples of additional additives are provided to illustrate the present invention, but they are not intended to limit it:

Metal Detergents

Detergents which may be employed in the present invention include alkyl or alkenyl aromatic sulfonates, calcium phenate, borated sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multiacid, and chemical and physical mixtures thereof.

Anti-Wear Agents

As their name implies, these agents reduce wear of moving metallic parts. Examples of such agents include, but are not limited to, zinc dithiophosphates, carbarmates, esters, and molybdenum complexes.

Rust Inhibitors (Anti-Rust Agents)

Anti-rust agents reduce corrosion on materials normally subject to corrosion. Examples of anti-rust agents include, but are not limited to, nonionic polyoxyethylene surface active agents such as polyoxyethylene lauryl ether, polyoxyethylene higher alcohol ether, polyoxyethylene nonyl phenyl ether, polyoxyethylene octyl phenyl ether, polyoxyethylene octyl stearyl ether, polyoxyethylene oleyl ether, polyoxyethylene sorbitol monostearate, polyoxyethylene sorbitol mono-oleate, and polyethylene glycol mono-oleate. Other compounds useful as anti-rust agents include, but are not limited to, stearic acid and other fatty acids, dicarboxylic acids, metal soaps, fatty acid amine salts, metal salts of heavy sulfonic acid, partial carboxylic acid ester of polyhydric alcohol, and phosphoric ester.

Demulsifiers

Demulsifiers are used to aid the separation of an emulsion. Examples of demulsifiers include, but are not limited to, block copolymers of polyethylene glycol and polypropylene glycol, polyethoxylated alkylphenols, polyesteramides, ethoxylated alkylphenol-formaldehyde resins, polyvinylalcohol derivatives and cationic or anionic polyelectrolytes. Mixtures of different types of polymers may also be used.

Friction Modifiers

Additional friction modifiers may be added to the lubricating oil of the present invention. Examples of friction modifiers include, but are not limited to, fatty alcohols, fatty acids, amines, ethoxylated amines, borated esters, other esters, phosphates, phosphites and phosphonates.

Multifunctional Additives

Additives with multiple properties such as anti-oxidant and anti-wear properties may also be added to the lubricating oil of the present invention. Examples of multifunctional additives include, but are not limited to, sulfurized oxymolybdenum dithiocarbamate, sulfurized oxymolybdenum organo phosphorodithioate, oxymolybdenum monoglyceride, oxymolybdenum diethylate amide, amine-molybdenum complexes, and sulfur-containing molybdenum complexes.

Viscosity Index Improvers

Viscosity index improvers, also known as viscosity modifiers, comprise a class of additives that improve the viscosity-temperature characteristics of the lubricating oil, making the oil's viscosity more stable as its temperature changes. Viscosity index improvers may be added to the lubricating oil composition of the present invention. Examples of viscosity index improvers include, but are not limited to, polymethacrylate type polymers, ethylene-propylene copolymers, styrene-isoprene copolymers, alkaline earth metal salts of phosphosulfurized polyisobutylene, hydrated styrene-isoprene copolymers, polyisobutylene, and dispersant type viscosity index improvers.

Pour Point Depressants

Pour point depressants are polymers that are designed to control wax crystal formation in lubricating oils resulting in lower pour point and improved low temperature flow performance. Examples of pour point depressants include, but are not limited to, polymethyl methacrylate, ethylene vinyl acetate copolymers, polyethylene polymers, and alkylated polystyrenes.

Foam Inhibitors

Foam inhibitors are used to reduce the foaming tendencies of the lubricating oil. Examples of foam inhibitors include, but are not limited to, alkyl methacrylate polymers, alkylacrylate copolymers, and polymeric organosiloxanes such as dimethylsiloxane polymers.

Metal Deactivators

Metal deactivators create a film on metal surfaces to prevent the metal from causing the oil to be oxidized. Examples of metal deactivators include, but are not limited to, disalicylidene propylenediamine, triazole derivatives, thiadiazole derivatives, bis-imidazole ethers, and mercaptobenzimidazoles.

Dispersants

Dispersants diffuse sludge, carbon, soot, oxidation products, and other deposit precursors to prevent them from coagulating resulting in reduced deposit formation, less oil oxidation, and less viscosity increase. Examples of dispersants include, but are not limited to, alkenyl succinimides, alkenyl succinimides modified with other organic compounds, alkenyl succinimides modified by post-treatment with ethylene carbonate or boric acid, alkali metal or mixed alkali metal, alkaline earth metal borates, dispersions of hydrated alkali metal borates, dispersions of alkaline-earth metal borates, polyamide ashless dispersants and the like or mixtures of such dispersants.

Anti-Oxidants

Anti-oxidants reduce the tendency of mineral oils to deteriorate by inhibiting the formation of oxidation products such as sludge and varnish-like deposits on the metal surfaces. Examples of anti-oxidants useful in the present invention include, but are not limited to, phenol type (phenolic) oxidation inhibitors, such as 4,4'-methylene-bis(2,6-di-tert-butylphenol), 4,4'-bis(2,6-di-tert-butylphenol), 4,4'-bis(2-methyl-6-tert-butylphenol), 2,2'-methylene-bis(4-methyl-6-tert-butylphenol), 4,4'-butylidene-bis(3-methyl-6-tert-butylphenol), 4,4'-isopropylidene-bis(2,6-di-tert-butylphenol), 2,2'-methylene-bis(4-methyl-6-nonylphenol), 2,2'-isobutylidene-bis(4,6-dimethylphenol), 2,2'-5-methylene-bis(4-methyl-6-cyclohexylphenol), 2,6-di-tert-butyl-4-methylphenol, 2,6-di-tert-butyl-4-ethylphenol, 2,4-dimethyl-6-tert-butyl-phenol, 2,6-di-tert-l-dimethylamino-p-cresol, 2,6-di-tert-4-(N,N'-dimethylaminomethylphenol), 4,4'-thiobis(2-methyl-6-tert-butylphenol), 2,2'-thiobis(4-methyl-6-tert-butylphenol), bis(3-methyl-4-hydroxy-5-tert-10-butylbenzyl)-sulfide, and bis(3,5-di-tert-butyl-4-hydroxybenzyl). Diphenylamine-type oxidation inhibitors include, but are not limited to, alkylated diphenylamine, phenyl-alpha-naphthylamine, and alkylated-alpha-naphthylamine. Other types of oxidation inhibitors include metal dithiocarbamate (e.g., zinc dithiocarbamate), and methylenebis(dibutyldithiocarbamate).

Applications

Lubricating oil compositions containing the oil soluble additive compositions disclosed herein are effective as either fluid and grease compositions for modifying the friction properties of the lubricating oil which may, when used as a crankcase lubricant, lead to improved mileage for the vehicle being lubricated with a lubricating oil of this invention.

The lubricating oil compositions of this invention may be used in marine cylinder lubricants as in crosshead diesel engines, crankcase lubricants as in automobiles and railroads, lubricants for heavy machinery such as steel mills and the like, or as greases for bearings and the like. Whether the lubricant is fluid or solid will ordinarily depend on whether a thickening agent is present. Typical thickening agents include polyurea acetates, lithium stearate and the like. The oil soluble additive composition of the invention may also find utility as an anti-oxidant, anti-wear additive in explosive emulsion formulations.

Additional Applications

The oil soluble additive compositions of the invention can be envisioned as hydrotreating catalyst precursors in addition to their use as lubricating oil additives. The oil soluble additive compositions of the invention can act as a catalyst precursor and can be contacted with hydrocarbons and decomposed, in the presence of hydrogen and sulfur or sulfur-bearing compounds to form an active catalyst for hydrotreating a hydrocarbonaceous feedstock. The oil soluble additive compositions of the invention can be heated to the decomposition temperature and decomposed in the presence of hydrogen a hydrocarbon, and sulfur or sulfur-bearing compounds, e.g., at "on-oil" conditions, to form the active catalyst species for hydrotreating.

The nature of the hydrocarbon is not critical, and can generally include any hydrocarbon compound, acyclic or cyclic, saturated or unsaturated, unsubstituted or inertly substituted. The preferred hydrocarbons are those which are liquid at ordinary temperatures, exemplary of which are such straight chain saturated acyclic hydrocarbons as octane, tridecane, eicosane, nonacosane, or the like; straight chain unsaturated acyclic hydrocarbons as 2-hexene, 1,4-hexadiene, and the like; branched chain saturated acyclic hydrocarbons as 3-methylpentane, neopentane, isohexane, 2,7,8-triethyldecane, and the like; branched chain unsaturated acyclic hydrocarbons such as 3,4-dipropyl-1,3-hexadiene-5-yne, 5,5-dimethyl-1-hexene, and the like; cyclic hydrocarbons, saturated or unsaturated, such as cyclohexane, 1,3-cyclohexadiene, and the like; and including such aromatics as cumene, mesitylene, styrene, toluene, o-xylene, or the like. The more preferred hydrocarbons are those derived from petroleum, including especially admixtures of petroleum hydrocarbons characterized as virgin naphthas, cracked naphthas, Fischer-Tropsch naphtha, light cycle oil, medium cycle oil, heavy cycle oil, and the like, typically those containing from about 5 to about 30 carbon atoms, preferably from about 5 to about 20 carbon atoms and boiling within a range of from about 30° C. to about 450° C., preferably from about 150° C. to about 300° C. In decomposing the oil soluble additive compositions of the invention to form a hydrotreating catalyst, a packed bed containing the oil soluble additive compositions of the invention is contacted in a hydrogen atmosphere with both the hydrocarbon and sulfur or sulfur-bearing compound and heated at conditions which decompose said oil soluble additive compositions of the invention.

The sulfur or sulfur-bearing compound is characterized as an organo-sulfur or hydrocarbyl-sulfur compound, which contains one or more carbon-sulfur bonds within the total molecule, and generally includes acyclic or cyclic, saturated or unsaturated, substituted or inertly substituted compounds. Exemplary of acyclic compounds of this character are ethyl sulfide, n-butyl sulfide, n-hexylthiol, diethylsulfone, allyl isothiocyanate, dimethyl disulfide, ethylmethylsulfone, ethylmethylsulfoxide, and the like; cyclic compounds of such character are methylthiophenol, dimethylthiophene, 4-mercaptobenzoic acid, benzenesulfonic acid, 5-formamido-benzothiazole, 1-naphthalenesulfonic acid, dibenzylthiophene, and the like. The sulfur must be present in at least an amount sufficient to provide the desired stoichiometry required for the catalyst, and preferably is employed in excess of this amount. Suitably, both the hydrocarbon and sulfur for the reaction can be supplied by the use of a sulfur-containing hydrocarbon compound, e.g., a heterocyclic sulfur compound, or compounds. Exemplary of heterocyclic sulfur compounds suitable for such purpose are thiophene, dibenzothiophene, tetraphenylthiophene, tetramethyldibenzothiophene, tetrahydrodibenzothiophene, thianthrene, tetramethylthianthrene, and the like. The hydrogen required for forming the catalysts of this invention may be pure hydrogen, an admixture of gases rich in hydrogen or a compound which will generate in situ hydrogen, e.g., a hydrogen-generating gas such as carbon monoxide mixtures with water, or a hydrogen donor solvent.

The following examples are presented to illustrate specific embodiments of this invention and are not to be construed in any way as limiting the scope of the invention

EXAMPLES

Example 1

Comparative

Molybdenum Sulfide Polyamide Additive

A 3 L glass reactor was charged with a 685 g of polyamide, prepared from isostearic acid and diethylenetriamine (ISA/DETA CMR=1.7), 751 g of diluent oil and 681 g of xylene. Reaction mixture was heated to a temperature of 70° C. where upon, 95 g of molybdenum trioxide and 57 g of water were then added. The reactor was then held at a reaction temperature of 90° C. for 2.5 hrs. After that, 42 g of sulfur was then added and the reaction was heated at 135° C. for an additional 3 hours. Reduced pressure was then applied to remove xylene and water for additional 1 hr.

Example 2

Ethylene Carbonate (EC) Treated Molybdenum Sulfide Polyamide Additive

A 3 L glass reactor was charged with a 535 g of molybdenum sulfide polyamide as prepared in Example 1. The molybdenum sulfide polyamide was allowed to heat up to 165° C. where upon, 34 g of ethylene carbonate was charged slowly over the duration of 1 hr. After that, the reaction was allowed to hold at 165° C. for additional 2 hr.

Example 3

Glycerine Carbonate (GC) Treated Molybdenum Sulfide Polyamide Additive

A 3 L glass reactor was charged with a 595 g of molybdenum sulfide polyamide as prepared in example 1, was charged. Reaction mixture was allowed to heat up to 165° C. where upon 28 g of glycerine carbonate was charged slowly over the duration of 1 hr. After that, the reaction was allowed to hold at 165° C. for additional 2 hr.

The product from Examples 1, 2, and 3 was blended at 500 ppm molybdenum in a partially formulated lubricating oil, containing other additives, such as, but not limited to, at least one dispersant, at least one carboxylate detergent, at least one sulfonate detergent, at least one anti-wear additive, at least one antioxidant, at least one viscosity index improver, at least one foam inhibitor and the remaining being a diluents oil.

Lubricating Oil Compositions (Lubricating Oils 1-4)

Lubricating oil compositions containing 500 ppm of molybdenum from molybdenum sulfide polyamide, EC treated molybdenum sulfide polyamide, or GC treated molybdenum sulfide polyamide were top treated with the following baseline formulation:

Baseline Formulation (1) 2 wt % of an oil concentrate of an ethylene carbonate post-treated ashless dispersant (2) 4.5 wt % of an oil concentrate of a borated dispersant (3) 2.48 wt % of an oil concentrate alkaline earth metal sulfonate detergent (4) 1.03 wt % of an oil concentrate zinc dialkyldithiophosphate (5) 0.9 wt % of an antioxidant (6) 0.2 wt % of an oil concentrate of a molybdenum succinimide complex (7) 9.4 wt % of an oil concentrate of a non-dispersant type viscosity index improver (8) 5 ppm of a foam inhibitor (9) remainder a Group III lubricating oil Lubricating Oil Composition (Comparative)—Lube Oil 5

A lubricating oil composition was prepared in accordance with the above baseline formulation except that 0.82 wt % of a molybdenum dithiocarbamate (available as "Sakura Lube 505" from AdekaUSA Corporation, Saddle River, N.J.) was the sole molybdenum source for this lubricating oil composition. The Mo content=500 ppm.

Figure 1 and Table 1 show that the post-treated molybdenum sulfide polyamide has a decreased torque as compared to a non-post-treated molybdenum sulfide polyamide.

The lubricating oil compositions described above were tested for friction performance in a motored engine friction torque test. The engine is an inline 4-cylinder type with a displacement of 1.8 liters. It has a roller-follower valve train system.

The motored engine friction torque test uses all engine parts such as cylinder-head, pistons and crankshaft and so on. A roller type valve system is employed. The motor is connected with the crankshaft through a torque meter. The oil temperature is controlled by an electric heater and ranges from 25-100° C. The speed of the engine was varied between 550-2000 rpm. Torque measurements were recorded for various temperatures (40° C., 60° C., 80° C. and 100° C.) at various speeds (rpm). Since the friction modifiers work only at high temperature, the results are shown only for 100° C. The results at 100° C. are shown as a torque change (%) and are summarized in Table 1. A higher negative number indicates a better torque change and a better fuel economy. For example, −5.0 has a better fuel economy than −1.0.

TABLE 1

Torque Change (%) at 100° C. at various speeds

| Speed (rpm) | Lube oil 1 Baseline | Lube oil 2 Baseline + Example 1 | Lube oil 3 Baseline + Example 2 | Lube oil 4 Baseline + Example 3 | Lube oil 5 Baseline + MoDTC |
|---|---|---|---|---|---|
| 550 | 0.60 | −1.46 | −3.23 | −3.32 | −5.17 |
| 650 | 0.85 | −1.22 | −2.45 | −2.57 | −3.94 |
| 750 | 0.91 | −0.96 | −1.80 | −1.83 | −2.88 |
| 850 | 1.17 | −0.73 | −1.37 | −1.42 | −2.17 |
| 900 | 1.32 | −0.70 | −1.15 | −1.22 | −1.86 |
| 1000 | 1.62 | −0.43 | −0.77 | −0.94 | −1.27 |
| 1250 | 1.96 | 0.25 | 0.14 | 0.00 | −0.07 |
| 1500 | 2.67 | 1.18 | 1.12 | 0.97 | 1.07 |
| 1750 | 3.21 | 1.68 | 1.71 | 1.64 | 1.79 |
| 2000 | 3.47 | 2.02 | 2.21 | 2.20 | 2.25 |

What is claimed is:

1. An oil soluble additive composition prepared by a process comprising reacting:

(1) a molybdenum component;

(2) an amide wherein said amide comprises the reaction product of a carboxylic acid component and a polyamine component, wherein the charge mole ratio of the carboxylic acid component to the polyamine component is about 2:1 to 1:1; and (3) a sulfur source wherein the ratio of sulfur to molybdenum is about 2:1;

and thereafter reacting the reaction product of (1), (2) and (3) with (4) a post-treating agent, wherein the post-treating agent is a cyclic carbonate.

2. The oil soluble additive composition of claim 1, wherein the molybdenum component is a molybdenum oxide.

3. The oil soluble additive composition of claim 1, wherein the molybdenum component is a molybdenum oxysulfide.

4. The oil soluble additive composition of claim 1, wherein the molybdenum component is a molybdenum sulfide.

5. The oil soluble additive composition of claim 1, wherein the amide contains at least one basic nitrogen.

6. The oil soluble additive composition of claim 1, wherein the carboxylic acid component is a carboxylic acid, carboxylic acid salt, carboxylic acid anhydride, carboxylic acid ester, or mixtures thereof.

7. The oil soluble additive composition of claim 1, wherein the carboxylic acid component is a fatty acid.

8. The oil soluble additive composition of claim 1, wherein the carboxylic acid component is isostearic acid, stearic acid, or mixtures thereof.

9. The oil soluble additive composition of claim 1, wherein the charge mole ratio of the carboxylic acid component to the polyamine component is about 1.7:1 to 1:1.

10. The oil soluble additive composition of claim 1, wherein the polyamine is a polyalkylene polyamine of the general formula $$H_2N(—R—NH)_n—H$$

and wherein R is an alkylene group of 2-3 carbon atoms and n is an integer of from 1 to 11.

11. The oil soluble composition of claim 1, wherein the polyamine is tetraethylenepentamine (TEPA), diethylenetriamine (DETA), ethylenediamine (EDA), or mixtures thereof.

12. The oil soluble additive composition of claim 1, wherein the molybdenum component is sulfurized.

13. The oil soluble additive composition of claim 1 wherein the cyclic carbonate is ethylene carbonate or glycerine carbonate.

14. A lubricating oil composition comprising:

a. an oil of lubricating viscosity and b. a post-treated reaction product obtained from the reaction of a cyclic carbonate post-treating agent with a product of the reaction of:

i. a molybdenum component;

ii. an amide wherein said amide comprises the reaction product of a carboxylic acid component and a polyamine component, wherein the charge mole ratio of the carboxylic acid component to the polyamine component is about 2:1 to 1:1; and iii. a sulfur source wherein the ratio of sulfur to molybdenum is about 2:1.

15. The lubricating oil composition of claim 14, wherein the molybdenum content of the lubricating oil composition is between about 50 ppm and 5000 ppm.

16. The lubricating oil composition of claim 14, wherein the oil soluble additive composition content is between 0.05 to 15% by weight.

17. The lubricating oil composition of claim 14, wherein the charge mole ratio of the carboxylic acid component to the polyamine component is about 1.7:1 to 1:1.

18. The lubricating oil composition of claim 14 wherein the cyclic carbonate is ethylene carbonate or glycerine carbonate.

19. A process for preparing an oil soluble additive composition which comprises reacting:

a. a molybdenum component;

b. an amide wherein said amide comprises the reaction product of a carboxylic acid component and a polyamine component, wherein the charge mole ratio of the carboxylic acid component to the polyamine component is about 2:1 to 1:1; and c. a sulfur source wherein the ratio of sulfur to molybdenum is about 2:1;

and thereafter reacting the reaction product of (a), (b) and (c) with d. a post-treating agent, wherein the post-treating agent is a cyclic carbonate.

20. The process of claim 19, wherein the molybdenum-containing reaction product is sulfurized in an amount sufficient to provide 0.01 to 12 atoms of sulfur per atom of molybdenum.

21. The process of claim 19, wherein said reaction of said molybdenum component and said amide is in the presence of a polar promoter.

22. The process of claim 21, wherein the polar promoter is selected from the group consisting of 1,3-propanediol, 1,4-butanediol, diethylene glycol, butyl cellosolve, propylene glycol, 1,4-butyleneglycol, methyl carbitol, ethanolamine, ammonium hydroxide, alkyl ammonium hydroxide, metal hydroxide, N-methyl-diethanol-amine, dimethyl formamide, N-methyl acetamide, dimethyl acetamide, methanol, ethylene glycol, dimethyl sulfoxide, hexamethyl phosphoramide, tetrahydrofuran, water, inorganic acid, and mixtures thereof.

23. The process of claim 22, wherein the polar promoter is water.

24. The process of claim 20, wherein the sulfurization is carried out with a sulfur source selected from sulfur, hydrogen sulfide, phosphorus pentasulfide, $R_2Sx$ where $R_2$ is hydrocarbyl, and x is at least 2, inorganic sulfides or inorganic polysulfides, thioacetamide, thiourea, mercaptans of the formula RSH where R is hydrocarbyl, or a sulfur-containing antioxidant.

25. The process of claim 19, wherein the molybdenum component is selected from the group consisting of molybdic acid, ammonium molybdate, sodium molybdate, potassium molybdate, metal molybdates, $MoOCl_4$, $MoO_2Br_2$, $Mo_2O_3Cl_6$, molybdenum trioxide, and mixtures thereof.

26. The process of claim 25, wherein the molybdenum component is molybdenum trioxide.

27. The process of claim 19, wherein the carboxylic acid component comprises a fatty acid.

28. The process of claim 19, wherein the carboxylic acid component comprises isostearic acid, stearic acid, or mixtures thereof.

29. The process of claim 19, wherein the polyamine component comprises a polyalkylenepolyamine represented by the general formula $$H_2N(—R—NH)_n—H$$

and wherein R is an alkylene group of 2-3 carbon atoms and n is an integer of from 1 to 11.

30. The process of claim 19, wherein the polyamine component is tetraethylenepentamine (TEPA), diethylenetriamine (DETA), ethylenediamine (EDA), or mixtures thereof.

31. The process of claim 19, wherein the cyclic carbonate is ethylene carbonate or glycerine carbonate.

32. An oil soluble additive composition comprising a post-treated reaction product obtained from the reaction of a cyclic carbonate post-treating agent with a product of the reaction of:

a. a molybdenum component;

b. an amide wherein said amide comprises the reaction product of acarboxylic acid component and a polyamine component, wherein the charge mole ratio of the carboxylic acid component to the polyamine component is about 2:1 to 1:1; and c. a sulfur source wherein the ratio of sulfur to molybdenum is about 2:1.

* * * * *